US011858598B2

(12) United States Patent
Cannon

(10) Patent No.: US 11,858,598 B2
(45) Date of Patent: Jan. 2, 2024

(54) WATER SKI WITH INTERCHANGEABLE TAIL SECTIONS

(71) Applicant: Connelly Skis, LLC, Lynnwood, WA (US)

(72) Inventor: Douglas A. Cannon, Arlington, WA (US)

(73) Assignee: Connelly Skis, LLC, Lynnwood, WA (US)

( * ) Notice: Subject to any disclaimer, the term of this patent is extended or adjusted under 35 U.S.C. 154(b) by 0 days.

(21) Appl. No.: 17/397,830

(22) Filed: Aug. 9, 2021

(65) Prior Publication Data

US 2022/0055719 A1 Feb. 24, 2022

Related U.S. Application Data

(60) Provisional application No. 63/067,222, filed on Aug. 18, 2020.

(51) Int. Cl.

| | |
|---|---|
| ***B63B 32/30*** | (2020.01) |
| ***B63B 32/64*** | (2020.01) |
| ***B63B 32/66*** | (2020.01) |

(52) U.S. Cl.

CPC ..... *B63B 32/30* (2020.02); *B63B 32/64* (2020.02); *B63B 32/66* (2020.02)

(58) Field of Classification Search

CPC ..... B63B 32/30; B63B 32/64; B63B 32/66
See application file for complete search history.

(56) References Cited

U.S. PATENT DOCUMENTS

| | | | | |
|---|---|---|---|---|
| 3,015,831 | A | 2/1958 | Franke | |
| 3,879,782 | A * | 4/1975 | Oliver | B63B 32/64 441/74 |
| 4,795,386 | A | 1/1989 | LaPoint | |
| 8,123,580 | B1 * | 2/2012 | Meyerhoffer | B63B 32/53 441/74 |
| 9,150,288 | B2 * | 10/2015 | Barr | B63B 32/40 |

FOREIGN PATENT DOCUMENTS

| | | | | |
|---|---|---|---|---|
| BR | PI-0621527 A2 * | 12/2011 | | |
| GB | 2469463 A * | 10/2010 | | B63B 35/7916 |
| WO | WO-2005002958 A1 * | 1/2005 | | B63B 35/7916 |

* cited by examiner

*Primary Examiner* — Andrew Polay
(74) *Attorney, Agent, or Firm* — Perkins Coie LLP

(57) ABSTRACT

A water ski system includes an elongate ski body member having an aft end portion with a mounting face. Interchangeable tail members having an engagement face are configured to be selectively mounted to the ski body such that the engagement face of the tail member abut the mounting face of the ski body member. Attachment hardware removably fixes the selected tail member to the ski body member. The interchangeable tail members may have a variety of shapes and lengths, allowing a skier to customize the water ski to accommodate differing water ski styles, water, conditions, and skill levels.

18 Claims, 6 Drawing Sheets

WATER SKI WITH INTERCHANGEABLE TAIL SECTIONS

CROSS-REFERENCE TO RELATED APPLICATION

This application claims the benefit of Provisional Application No. 63/067,222, filed Aug. 18, 2020.

BACKGROUND

Water skiing is a popular recreational and competitive water sport and is practiced in a variety of variations. A water skier may use a single water ski ("slalom skiing") or may use two skis ("combo skiing"). There are many variations of water skiing for recreational and competitive water skiers, including speed skiing, trick skiing, show skiing, slaloming, jumping, and wake-skiing. In other variations a relatively short and wide water ski, referred to as a wakeboard is used (water ski is herein defined to include wakeboards), usually without any straps or bindings. U.S. Pat. No. 6,533,625, to Taylor, which is hereby incorporated by reference, discloses a water ski having a tail fin extending into the water and a plurality of channels formed on a bottom side of the water ski, and configured to give improved hydrodynamic performance.

In one example, a water skier enters the water, engages their feet with the water ski(s) and grasps a handle portion of a ski rope having an opposite end attached to a watercraft. The watercraft accelerates, pulling the skier through the water. The water skier maneuvers their body and the water ski(s) such that the water ski(s) begin to plane over the surface of the water, raising the water skier to a generally upright position. The sport requires upper and lower body strength, endurance, and balance. In variations on the sport the ski rope may be pulled by other means, for example, by an electrically driven cable ("cable skiing").

Conventional water skis have very limited adaptability for accommodating different skiers and skier skill levels, different skiing activities, and different water conditions. For example, typically the heavier a water skier the bigger the ideal water ski(s) will be. The ideal length of the water ski may also vary based on the type of water skiing being performed. For example, jump skis are typically longer than skis typically used in recreational skiing. Different ski lengths and configurations may also be desired for competitive slalom skiing and trick skiing.

The length and shape of the aft end portion, or "tail," of a water ski significantly affects the performance of the water ski. For example, a ski with a generally "square" tail (i.e., a tail shape defining approximately ninety-degree angles on either side and a straight or slightly arced back edge therebetween), typically results in a faster ski, whereas a ski with a more rounded tail may produce a slower ski. The tail shape may also impact the turning performance of the water ski, for example the turning radius of the ski. The length and shape of the tail of the water ski may also affect the ski's attitude or height in the water. A water ski with a square tail may sit higher in the water than a similar water ski having a round tail. The tail of the water ski impacts overall performance of the ski, such as the lift, ease of turning, drag, and general maneuverability of the water ski. Moreover, as a water skier gains experience and skill, the skier may wish to transition to water skis having different tail shapes.

Conventional water ski boards are made as a unitary structure. A water skier desiring to engage in different styles of water skiing in different water conditions may need to obtain multiple water skis or sets of water skis to accommodate different styles and conditions. It would be beneficial to provide a water ski (or pair of water skis) wherein the tail of the water ski could be readily changed to modify the shape of the tail and/or the overall length of the water skis.

Conventional approaches to the design of water skis suffer from one or more disadvantages, including requiring a skier to utilize different skis to obtain the benefits of different tail designs. Embodiments of the invention are directed toward solving these and other problems individually and collectively.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The terms "invention," "the invention," "this invention," and "the present invention" as used herein are intended to refer broadly to all of the subject matter described in this document and to the claims. Statements containing these terms should be understood not to limit the subject matter described herein or to limit the meaning or scope of the claims. Embodiments of the invention covered by this patent are defined by the claims and not by this summary. This summary is a high-level overview of various aspects of the invention and introduces some of the concepts that are further described in the Detailed Description section below. This summary is not intended to identify key, essential or required features of the claimed subject matter, nor is it intended to be used in isolation to determine the scope of the claimed subject matter. The subject matter should be understood by reference to appropriate portions of the entire specification of this patent, to any or all drawings, and to each claim.

Embodiments of the invention are directed to a water ski having an interchangeable tail section and a system that includes a water ski body and one or more interchangeable tail sections. In some embodiments, this is achieved by incorporating an attachment component or element into both the water ski body and tail section, the attachment components or elements able to be inserted, coupled, fastened, or otherwise connected to enable fastening of the tail section to the water ski body, while permitting removal of the tail section and attachment of a different tail section.

A water ski system includes a ski body member having a mounting face and at least one interchangeable tail member having an engagement face configured to abut the mounting face. Attachment hardware removably attaches the interchangeable tail member to the ski body member such that the engagement face of the at least one tail member abuts the mounting face of the ski body member.

In an embodiment the tail member has a plurality of apertures, and a plurality of threaded inserts are installed in the ski body member, such that the tail member is fixed to the ski body member by bolts extending through the apertures to engage the threaded inserts.

In an embodiment the tail member engagement face has a plurality of recesses and the threaded inserts have annular head portions that extend away from the ski body member mounting face to slidably engage the plurality of recesses.

In an embodiment either the engagement face or the mounting face have a shaped projection and the other of the engagement face and the mounting face have a shaped recess configured to receive the shaped projection. In some embodiments more than one shaped projection and corresponding recess are provided. In an embodiment the shaped projection(s) are conical projection or wedge-shaped projection(s).

In an embodiment one of the mounting face and the engagement face is a convex face and the other of the mounting face and the engagement face is a concave face that receives the convex face.

In an embodiment the attachment hardware is an elongate connecting member attached to an upper surface of the ski body member such that an aft portion of the elongate connecting member extends beyond the mounting face and releasably attaches to an upper surface of the at least one tail member.

In an embodiment the system includes a plurality of tail members, including one or more asymmetric tail members, for example, a tail member that is relatively short on one side and relatively long on an opposite side.

In an embodiment at least one of the plurality of tail members comprises a diamond-shaped tail member that is relatively long near a centerline and relatively short near a centerline.

In an embodiment at least one of the plurality of tail member comprises a V-shaped tail member that is relatively short near a centerline and relatively long near opposite sides.

In an embodiment at least some of the plurality of tail members comprises a rounded back edge.

A water ski system includes a ski body member having a front tip portion and an aft end portion, wherein the aft end portion has a mounting face, and a plurality of interchangeable tail members, each tail member having an engagement face configured to abut the mounting face using attachment means for removably and selectively attaching each of the plurality of tail members to the ski body member such that the engagement face of the selected tail member abuts the mounting face of the ski body member.

In an embodiment the plurality of interchangeable tail members includes at least one symmetrical tail member and at least one non-symmetrical tail member.

In an embodiment the plurality of interchangeable tail members includes tail members having different lengths.

In an embodiment the plurality of interchangeable tail members includes a tail member having a conventional shape, a tail member having a diamond shape, a tail member having a V-shape, and a tail member having a length and a width, wherein the length is greater than the width.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

A water skier may desire to use a water ski or skis having a particular tail shape and/or a particular length that is optimal for a desired water-skiing activity. Some factors that may impact a preferred water ski configuration include i) the type of water skiing to be engaged in; ii) the water temperature; iii) the water motion; and/or iv) the experience of the water skier.

A skiers optimal water ski configuration in warmer water may be different from the optimal water ski configuration in colder water. For example, a water ski will typically ride deeper in warm water. A water skier may prefer skis having a round tail in cold water and a water ski having a square tail in warmer water to achieve similar performance in either environment. However, it is expensive and inconvenient to have to purchase and transport multiple skis, or multiple sets of skis, to accommodate differing conditions. It would be advantageous to water skiers to be able to adapt a water ski configuration to particular situations in situ. It would also be advantageous to water skiers to be able to adapt a water ski to multiple different configurations to find the configuration that is most comfortable or effective for the particular skier.

Embodiments of the water ski systems contemplated herein include a ski body member and a plurality of interchangeable tail members and that are configured to be securely attached to the ski body member. The interchangeable tail sections may be shaped and/or sized to provide different operating characteristics, for example, to optimize skiing speed, turning performance, jumping, and the like.

Figure 1:
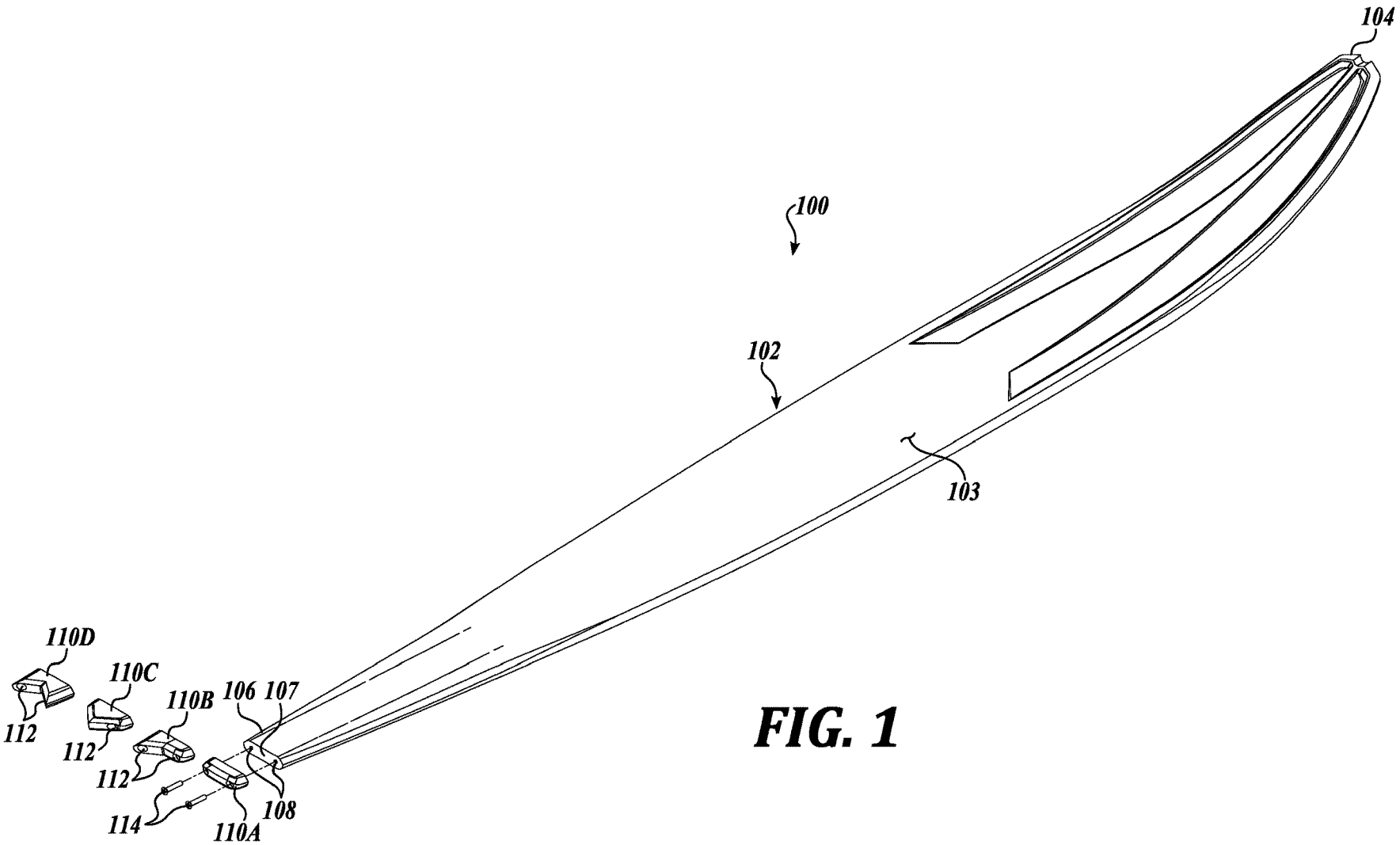
FIG. 1 is an exploded perspective view of a water ski system in accordance with the present invention, and comprising a ski body member, a plurality of interchangeable tail members, and connecting hardware.

FIG. 1 is a perspective view of a water ski system 100 in accordance with the present invention. The water ski system 100 may be, for example, a slalom water ski system or a ski for use in combo water skiing. The water ski system 100 includes a ski body member 102 and a plurality of interchangeable tail members (four shown) 110A, 110B, 110C, 110D configured to be selectively attached to the ski body member 102. The ski body member 102 has a middle portion 103, which may be configured to be stood on by a user, and may be configured with a boot or other binding (not shown), a front tip portion 104 extending forwardly from the middle portion 103, and an aft end portion 106 extending rearwardly from the middle portion 103. The distal surface of the end portion 106 defines an attachment face 107. A plurality of attachment members, for example, threaded inserts 108 (two shown) are fixedly installed in the end portion 106 and are accessible from the attachment face 107. Other attachment mechanisms are contemplated as are well known to persons of skill in the art. Although two threaded inserts 108 are shown, it is contemplated that more than two threaded inserts 108 may be used.

The interchangeable tail members 110A, 110B, 110C, 110D are configured to be securely and interchangeably attached to the end portion 106 of the ski body member 102 such that the selected tail member engages the attachment face 107. In a current embodiment each of the interchangeable tail members 110A, 110B, 110C, 110D include a plurality of through apertures 112 spaced apart and configured to be aligned with corresponding ones of the plurality of threaded inserts 108. Threaded fasteners, for example bolts 114, extend through corresponding apertures 112 in the selected tail member and engage the threaded inserts 108 to fixedly attach a selected one of the tail members 110A, 110B, 110C, 110D to the ski body member 102.

Although four tail members 110A, 110B, 110C, 110D are shown, it will be appreciated by persons of skill in the art that the system 100 may include more or fewer tail members. For example, in some embodiments any or all of the tail members 110A, 110B, 110C, 110D may be provided in a plurality of lengths, allowing the user to modify the length of the assembled ski.

In a method of using the water ski system 100, a user selects a desired one of the interchangeable tail members 110A, 110B, 110C, 110D. The selected tail member is then positioned adjacent to the attachment face 107, and the attachment members 114 are inserted through corresponding tail member apertures 112 to engage the threaded inserts 108, and the bolts 114 are tightened to secure the selected tail member to the ski body member 102. It is contemplated that a plurality of attachment members 114 may be provided in a number of lengths to accommodate tail members of differing lengths. In this exemplary embodiment four interchangeable tail members include i) a conventional tail member 110A; ii) an asymmetric tail member 110B wherein one side of the tail member is longer than an opposite side; iii) a diamond-shaped tail member 110C wherein the tail member is relatively long near its centerline and relatively short near its ends; and iv) a V-shaped tail member 110D wherein the tail member is relatively short near its center and relatively long near its ends. Other tail shapes are contemplated, for example, as shown in FIGS. 6A-6L.

With the conventional tail member 110A attached to the ski body member 102, for example, the water ski will perform similar to a conventional water ski. Other tail shapes and sizes will perform differently. For example, with the asymmetric tail member 110B attached to the ski body member 102 the water ski 100 will perform differently when turning left than it will when turning right. A water skier may have a 'good' turning direction wherein the skier is more comfortable, and a 'bad' turning direction that the skier finds more challenging. The asymmetric response provided by the tail member 110B provides certain selectable advantages to the skier to accommodate personal preferences and skills and allows a user to tune the water ski to the user's preferences or training goals. The diamond-shaped tail member 110C may cause the aft end of the water ski system 100 to set slightly higher in the water and will be easier to roll the water ski 100 left or right, for better turn initiation. The V-shaped tail member 110D allows the aft end of the water ski system 100 to set more neutrally in the water and provides for increased speed when exiting a turn.

Figure 2A:
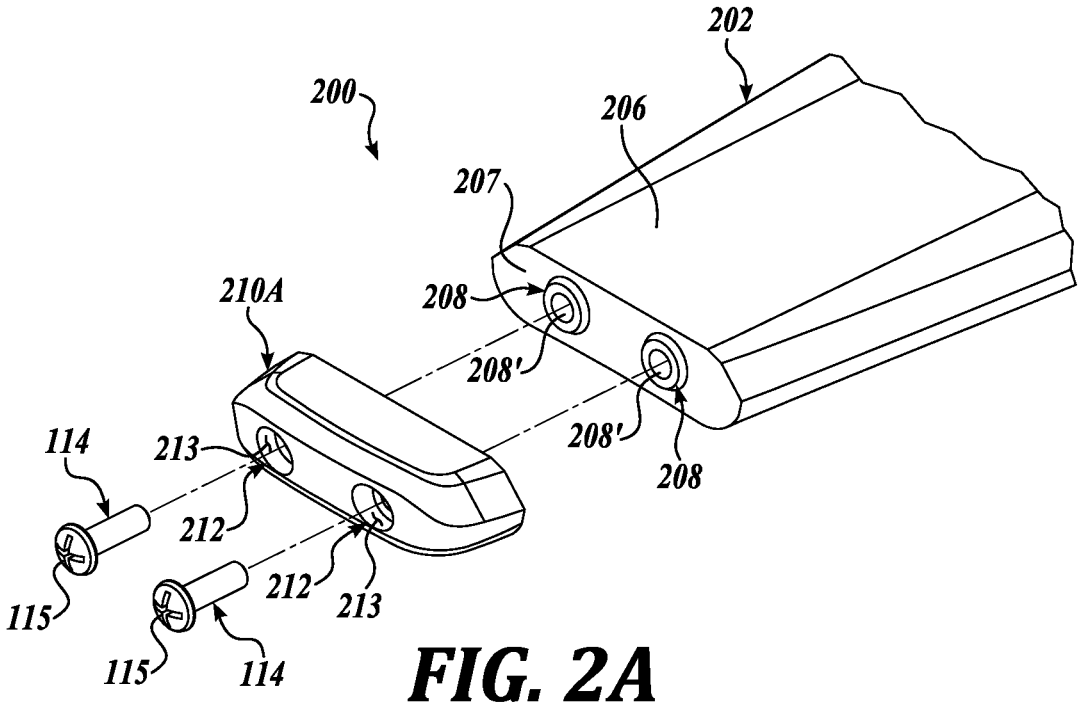
FIGS. 2A and 2B are exploded detail views of an embodiment of a water ski system in accordance with the present invention, showing a tail end of a ski body member and an interchangeable tail member wherein an attachment face of the ski body member includes tapered annular projections that engage corresponding recesses in the tail member.
Figure 2B:
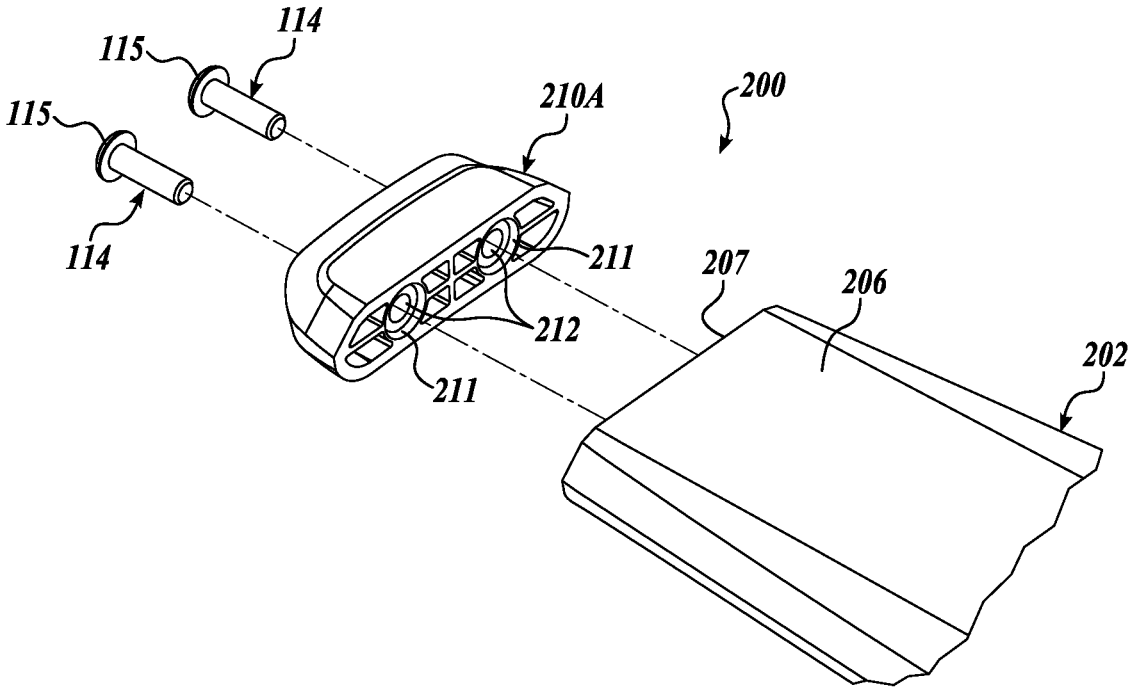

FIGS. 2A and 2B show exploded detail views of an aft portion of another water ski system 200 in accordance with the present invention. FIG. 2A shows the system 200 from a rear angle illustrating an aft attachment face 207 of the ski body member 202, and FIG. 2B shows the exploded view from a front angle illustrating a front face of an interchangeable tail member 210A. Except as discussed below, the water ski systems shown are similar to the water ski system 100 shown in FIG. 1, and in particular include or accommodate two or more different-shaped interchangeable tail members, for example, two or more of a conventional, an asymmetric, a diamond-shaped, and/or a V-shaped tail member. Only one interchangeable tail members is shown in FIGS. 2A and 2B (and subsequent FIGURES), for clarity.

The ski body member 202 has an attachment face 207 configured to engage any of a plurality of tail members (tail member 210A shown). Threaded inserts 208 are installed in the aft end portion 206 of the ski body member 202. The inserts 208 in this embodiment include a shaped head, for example, a tapered annular engagement portion 208' that protrudes from the planar attachment face 207. The front face of the tail section 210A includes corresponding circular recesses 211 configured to slidably receive the engagement portions 208'. In another embodiment (not shown) the threaded inserts do not have shaped heads/engagement portions 208', but rather the attachment face 207 of the ski body member 202 defines tapered annular protrusions, and the threaded inserts are installed through the corresponding tapered annular protrusions. The tail member 210A includes through apertures 212 to receive the bolts 114 therethrough, including recesses 213 sized to receive the heads 115 of the bolts 114.

Figure 3A:
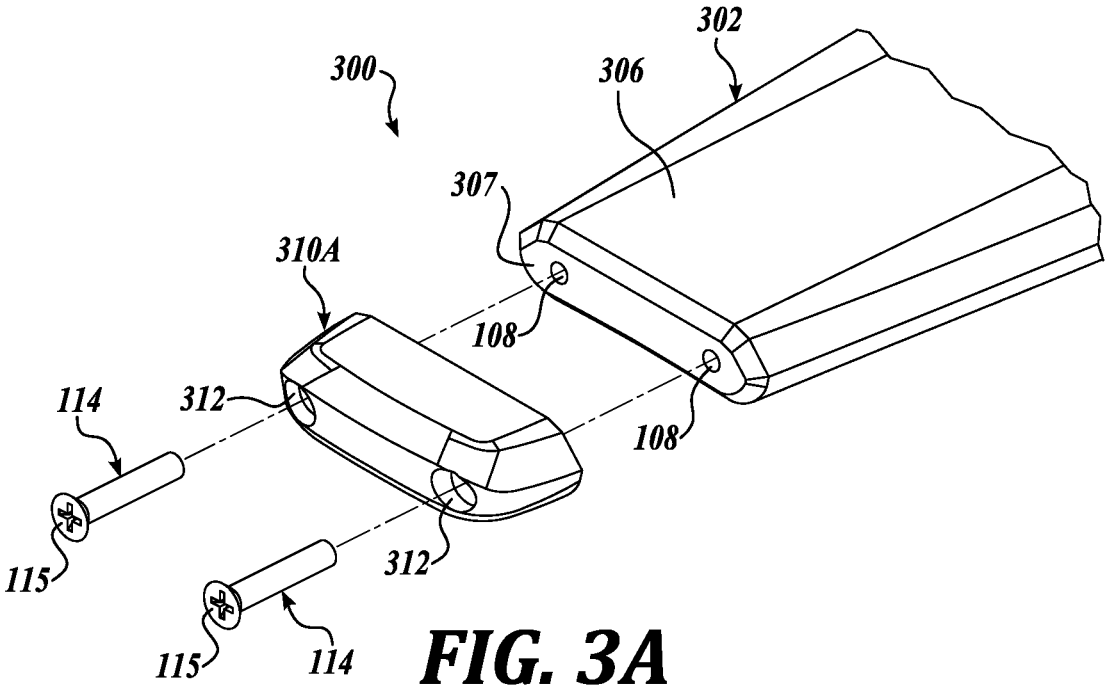
FIGS. 3A and 3B are exploded detail views of another embodiment of a water ski system in accordance with the present invention showing a tail end of a ski body member and an interchangeable tail member wherein an attachment face of the ski body member is convex and is configured to be received into a concave face of the tail member.
Figure 3B:
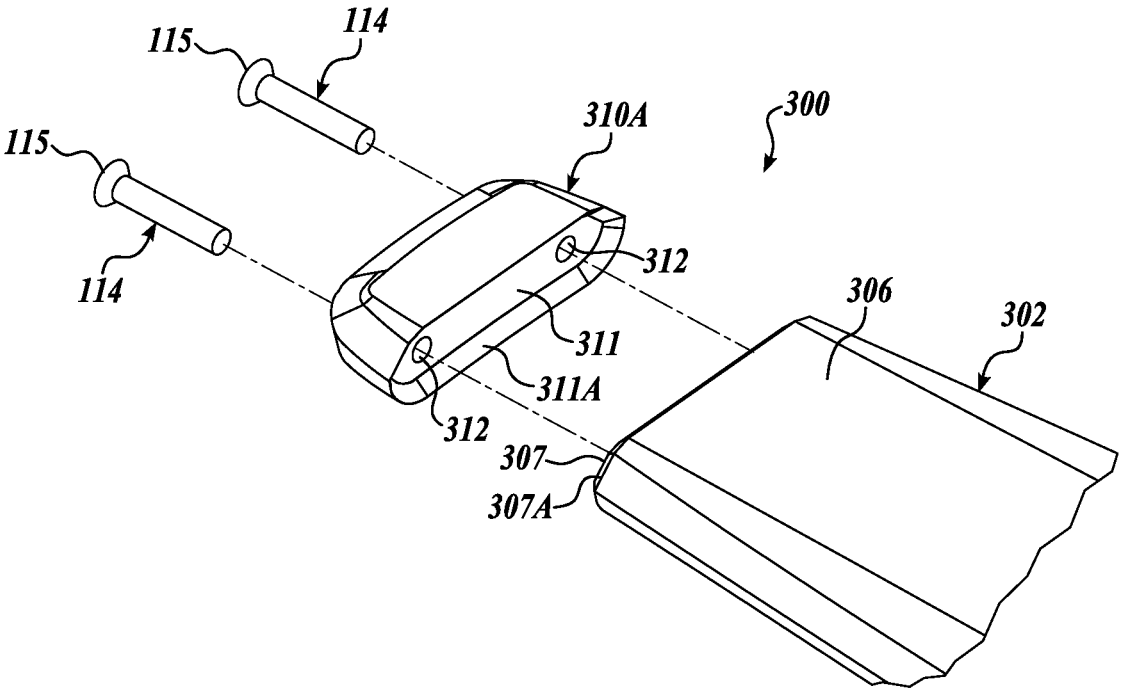

FIGS. 3A and 3B show exploded views of an aft portion of another embodiment a water ski system 300 in accordance with the present invention having a ski body member 302 and a plurality of tail members (one tail member 310A shown). In this embodiment the attachment face 307 on the end portion 306 of the ski body member 302 is convex and the tail member 310A has a concave face 311 configured to receive and abut the convex attachment face 307 of the ski body member 302. For example, the attachment face 307 may include a peripheral chamfer 307A, and the end portion 306 may include a corresponding angled peripheral wall 311A. Attachment members 114 extend through apertures 312 in the tail member 310A and engage threaded inserts 108 to releasably and securely fix the tail member 310A to the ski body member 302. In another similar embodiment (not shown), the attachment face on the end portion of the ski body member is concave, and the tail members each have a convex face shaped to engage the concave end portion of the ski body member. Through apertures 312 are positioned to receive bolts 114 therethrough to engage threaded inserts 108.

Figure 4A:
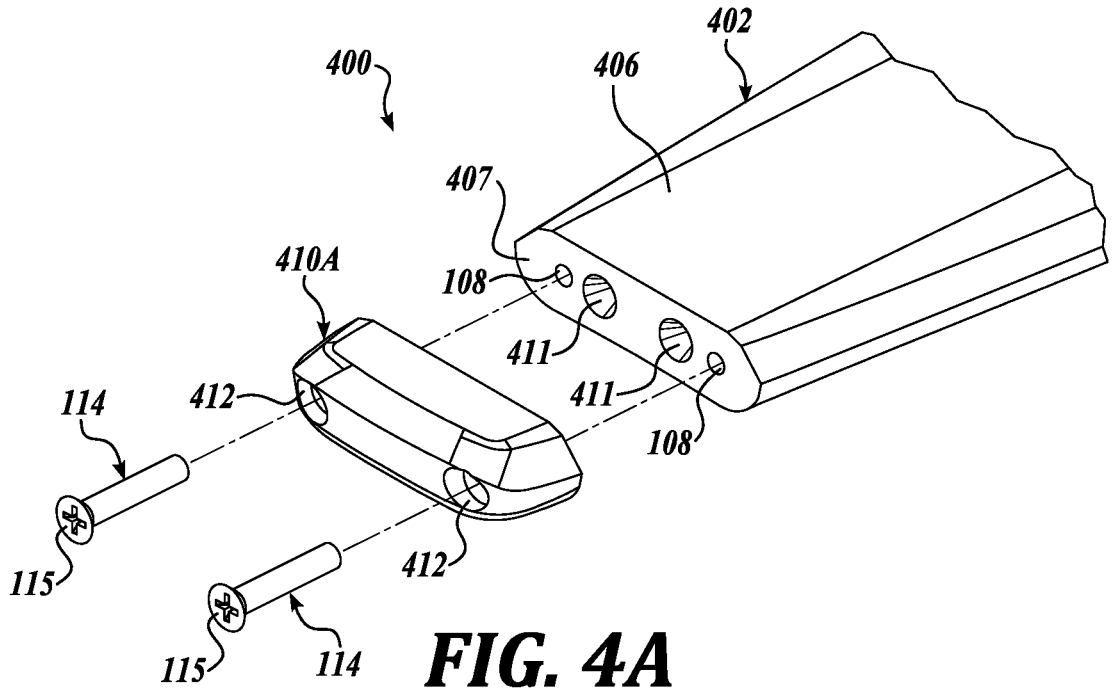
FIGS. 4A and 4B are exploded detail views of another embodiment of a water ski system in accordance with the present invention showing a tail end of a ski body member and an interchangeable tail member wherein an attachment face of the ski body member includes one or more shaped recesses (two shown), and the tail member includes corresponding projections that are shaped and positioned to be received into the shaped recesses.
Figure 4B:
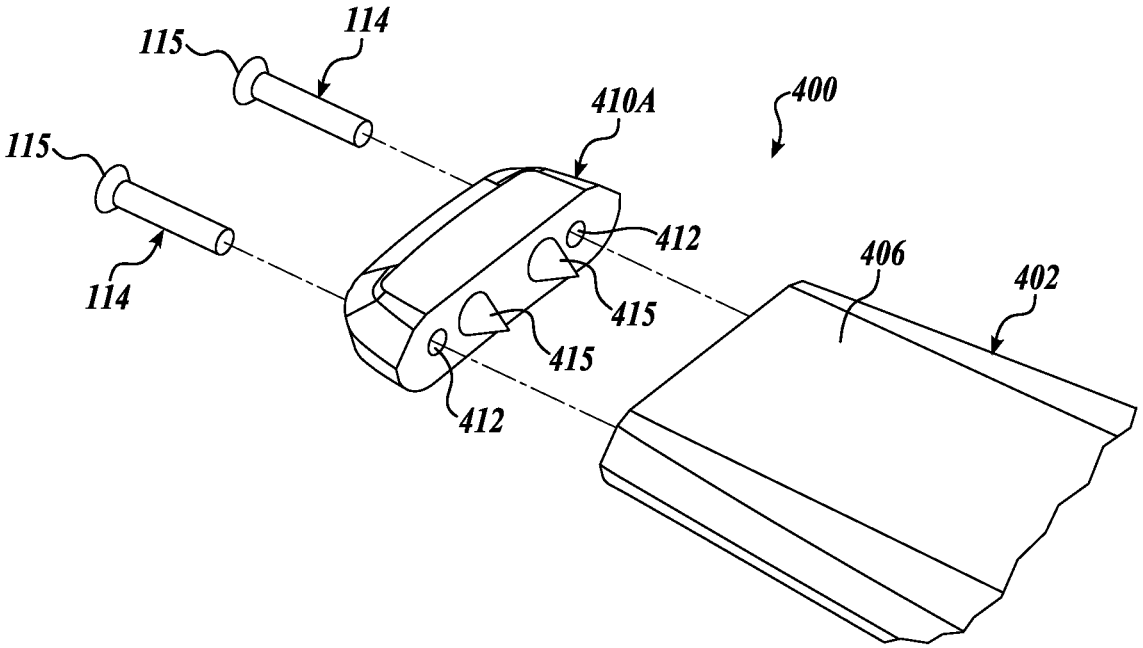

FIGS. 4A and 4B show exploded views of an aft portion of another embodiment of a water ski system 400 in accordance with the present invention. Except as described below, the water ski system 400 is similar to the water ski system 100 described above and includes a ski body member 402 and a plurality of tail members (tail member 410A shown). In this embodiment the attachment face 407 on the aft end 406 of the ski body member 402 has two, spaced and shaped recesses 411 located between the threaded inserts 108. In this exemplary embodiment the recesses 411 are conical. The tail member 410A further comprises projections 415 that are sized, shaped, and positioned to snugly engage the shaped recesses 411. The shaped recesses 411 aid in accurately positioning the tail member 410A on the ski body member 402 and provide additional support to the connection between the tail member 410A and the ski body member 402. Attachment members 114 extend through apertures 412 and engage the threaded inserts 108 to attach the selected tail member 410 to the ski body member 402.

In other embodiments (not shown) shaped recesses are formed in the tail members and corresponding projections extend from the ski body member. In other embodiments more or fewer shaped projections/recesses may be included. For example, in an embodiment a single elongate wedge-shaped projection extends from the tail member and is closely received in a corresponding wedge-shaped recess in the ski body member. In other embodiments, more than two projections/recesses may be provided.

Figure 5:
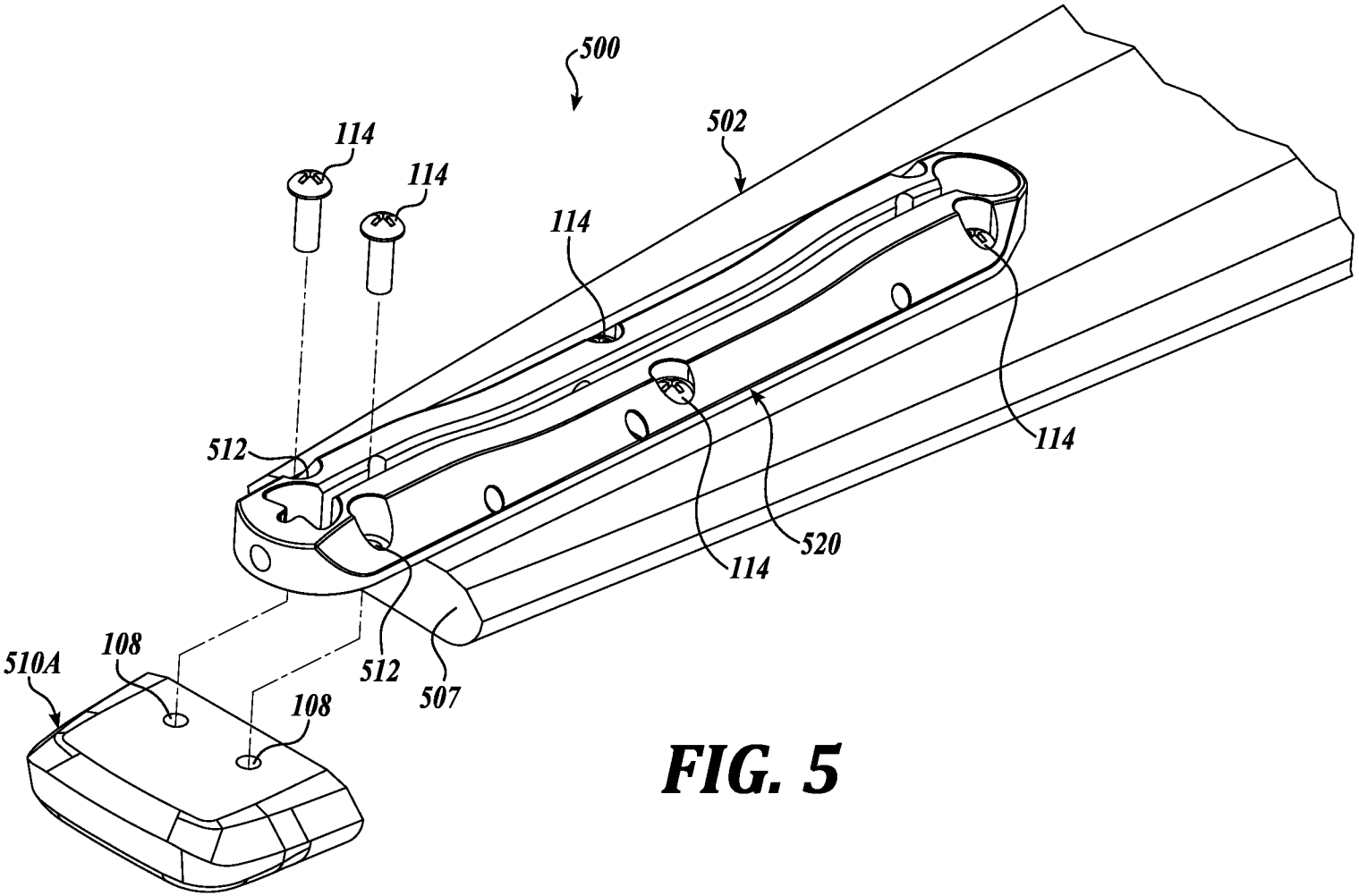
FIG. 5 is a partially exploded detail view of another embodiment of a water ski system in accordance with the present invention, showing a tail end of the ski body member, an interchangeable tail member, and an elongate connecting member attached to an upper face of the ski body member and removably attachable to an upper surface of the interchangeable tail member to secure the tail member to the ski body member.

FIG. 5 is a partially exploded view of an aft portion of another embodiment of a water ski system 500 in accordance with the present invention. Except as described below, the water ski system 400 is similar to the water ski system 100 described above and preferably includes a plurality of tail members. In this embodiment a ski body member 502 is configured to engage a plurality of interchangeable tail members (tail member 510A shown) through a connecting member 520 that is attached to an upper surface of the ski body member 502. The connecting member 520 is removably attached to an upper surface of any of a plurality of interchangeable tail members, for example tail member 510A. In this embodiment the tail members, for example tail member 510A, include a pair of spaced apart threaded inserts 108 that are accessible from an upper surface of the tail member 510A. The connecting member 520 includes through apertures 512 that are configured to receive bolts 114 therethrough, to engage the corresponding threaded inserts 108 in the selected tail member 510A to fix the tail member 510A adjacent to the ski body member 502, adjacent to the end face 507. The connecting member 520 may be permanently or removably attached to the ski body member 502. Alternatively, the connecting member 510A may be permanently attached to the tail member 510A, and removably attached to the ski body member 502.

FIGS. 6A-6L illustrate, in plan view, examples of interchangeable tail members 110A-110L that in some embodiments may comprise portions of a water ski system 100 in accordance with the present invention.

Figure 6A:
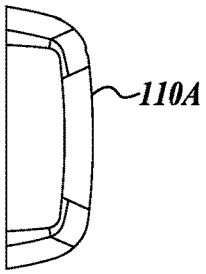
FIGS. 6A-6L are plan views of interchangeable tail members for the water ski system shown in FIG. 1.
Figure 6B:
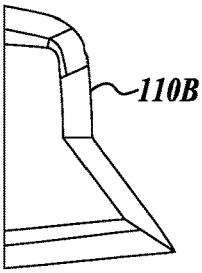
Figure 6C:
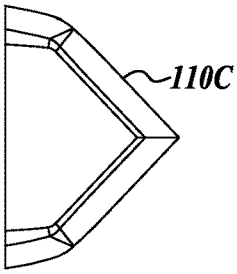
Figure 6D:
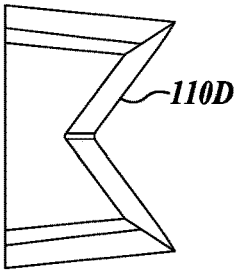
Figure 6E:
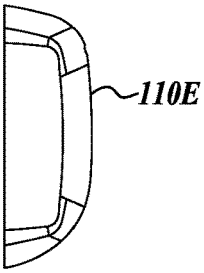
Figure 6F:
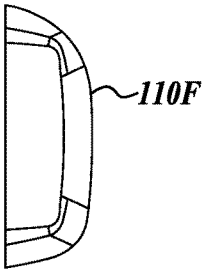
Figure 6G:
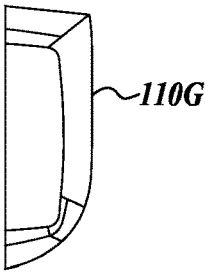
Figure 6H:
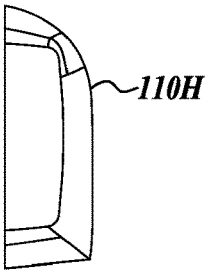
Figure 6I:
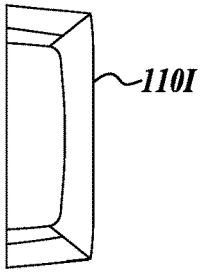
Figure 6J:
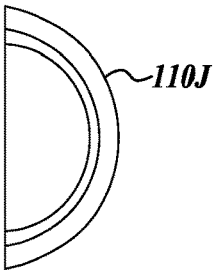
Figure 6K:
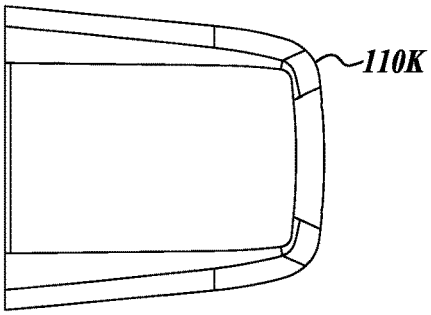
Figure 6L:
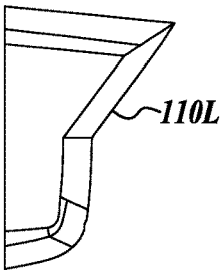

FIG. 6A shows a conventional, symmetric tail member 110A. FIG. 6B shows an asymmetric tail member 110B with an extended left side portion defining an acute angle. FIG. 6C shows a symmetric tail member 110C with an angled back edge portion defining a ninety-degree angle. FIG. 6D shows a symmetric tail member 110D defining a central sharply angled recess. FIG. 6E illustrates a tail member 110E similar to the conventional tail member 110A but with an asymmetry having the right side curved more sharply than the left side, and FIG. 6F illustrates a similar tail member 110F having the left side curved more sharply than the right side. FIG. 6G shows a tail member 110G wherein the right side forms a sharp angle with the back edge of the tail member 110G, and FIG. 6H shows a tail member 110H similar to tail member 110G, except the left side forms a sharp angle with the back edge of the tail member 110H. FIG. 6I shows a symmetric tail member 110I having sharp angles formed on both sides of the tail member 110I. FIG. 6J shows a symmetric tail member 110J having a half-circle or half-oval shape. FIG. 6K shows a tail member 110K having a conventional symmetric shape but having a extended length, in this example the length of the tail member 110K is greater than its width. The tail member 110K will therefore significantly extend the length of the ski. FIG. 6L shows an asymmetric tail member 110L similar to tail member 110B, but with the extended portion on the right side.

While illustrative embodiments have been illustrated and described, it will be appreciated that various changes can be made therein without departing from the spirit and scope of the invention.

The embodiments of the invention in which an exclusive property or privilege is claimed are defined as follows:

1. A water ski system comprising:

a ski body member having a front tip portion and an aft end portion, the aft end portion comprising a mounting face that has a peripheral chamfer;

at least one removable tail member having an engagement face configured to abut the mounting face; and attachment hardware configured to removably attach the at least one tail member to the ski body member, wherein:

the engagement face has an angled peripheral wall configured to abut the peripheral chamfer of the mounting face when the engagement face of the at least one tail member abuts the mounting face of the ski body member.

2. The water ski system of claim 1, wherein the at least one tail member comprises a plurality of apertures and further wherein the attachment hardware comprises a plurality of threaded inserts installed in the ski body member and a plurality of bolts, each bolt configured to extend through one of the plurality of apertures to engage a corresponding one of the plurality of threaded inserts.

3. The water ski system of claim 2, wherein the at least one tail member engagement face comprises a plurality of recesses, and further wherein the threaded inserts each comprise an annular head portion that extends away from the mounting face and is positioned to slidably engage a corresponding one of the plurality of recesses.

4. The water ski system of claim 2, wherein one of the engagement face and the mounting face comprises at least one shaped projection and the other one of the engagement face and the mounting face comprises at least one shaped recess configured to receive the at least one shaped projection.

5. The water ski system of claim 4, wherein the at least one shaped projection comprises a plurality of shaped projections, and the at least one shaped recess comprises a plurality of shaped recesses.

6. The water ski system of claim 4, wherein the at least one shaped projection comprises one of a conical projection and a wedge-shaped projection.

7. The water ski system of claim 1, wherein one of the mounting face and the engagement face is a convex face and the other of the mounting face and the engagement face is a concave face, wherein the concave face is configured to receive the convex face.

8. The water ski system of claim 1, wherein the attachment hardware comprises an elongate connecting member attached to an upper surface of the ski body member such that an aft portion of the elongate connecting member extends beyond the mounting face, wherein the aft portion is configured to be releasably attached to an upper surface of the at least one tail member.

9. The water ski system of claim 1, wherein the at least one tail member comprises a plurality of tail members.

10. The water ski system of claim 9, wherein at least one of the plurality of tail members comprises an asymmetric tail member.

11. The water ski system of claim 10, wherein at the asymmetric tail member is relatively short on one side and relatively long on an opposite side.

12. The water ski system of claim 9, wherein at least one of the plurality of tail members comprises a diamond-shaped tail member that is relatively long near a centerline and relatively short near an end.

13. The water ski system of claim 9, wherein at least one of the plurality of tail member comprises a V-shaped tail member that is relatively short near a centerline and relatively long near opposite sides.

14. The water ski system of claim 9, wherein at least one of the plurality of tail members comprises a tail member having a rounded back edge.

15. A water ski system comprising:

a ski body member having a front tip portion and an aft end portion, the aft end portion comprising a mounting face that has a peripheral chamfer;

a plurality of interchangeable tail members, each tail member having an engagement face configured to abut the mounting face; and an attachment means for removably and selectively attaching each of the plurality of tail members to the ski body member, wherein:

the engagement face of each of the plurality of interchangeable tail members has an angled peripheral wall configured to abut the peripheral chamfer of the mounting face when the engagement face of the interchangeable tail member abuts the mounting face of the ski body member.

16. The water ski system of claim 15, wherein the plurality of interchangeable tail members comprise at least one symmetrical tail member and at least one non-symmetrical tail member.

17. The water ski system of claim 15, wherein the plurality of interchangeable tail members include tail members having different lengths.

18. The water ski system of claim 15, wherein the plurality of interchangeable tail members comprise a tail member having a conventional shape, a tail member having a diamond shape, a tail member having a V-shape, and a tail member having a length and a width, wherein the length is greater than the width.

* * * * *